United States Patent [19]

Blevins et al.

[11] 4,413,465

[45] Nov. 8, 1983

[54] STIRRUP ADJUSTING AND LOCKING DEVICE

[76] Inventors: Earl L. Blevins; Joan V. Blevins, R.R. 2, both of Wheatland, Wyo. 82201

[21] Appl. No.: 330,486

[22] Filed: Dec. 14, 1981

[51] Int. Cl.[3] ..... B68C 1/16; A44B 11/20

[52] U.S. Cl. ..... 54/46; 24/311; 24/164; 24/177

[58] Field of Search ..... 54/47, 48, 49, 46, 45; 24/163 R, 164, 166, 167, 170, 174, 175, 177, 178, 191, 307, 311, 320

[56] References Cited

U.S. PATENT DOCUMENTS

| | | | |
|---|---|---|---|
| 2,482,153 | 9/1949 | Cavin | 54/46 |
| 2,608,733 | 9/1952 | Wilber | 24/191 |
| 3,096,552 | 7/1963 | Kreger, Jr. | 54/46 |
| 3,205,637 | 9/1965 | Welton | 54/46 |
| 4,141,198 | 2/1979 | Gaertner | 54/46 |
| 4,233,717 | 11/1980 | Horst et al. | 24/166 |

FOREIGN PATENT DOCUMENTS

| | | | |
|---|---|---|---|
| 494067 | 10/1938 | United Kingdom | 24/166 |

*Primary Examiner*—Gene Mancene
*Assistant Examiner*—Kris R. Schulza
*Attorney, Agent, or Firm*—D. Paul Weaver

[57] ABSTRACT

A secure positively adjusting and locking buckle for saddle stirrup straps is provided in which the buckle components cannot slide on the strap following proper adjustment. The buckle components cannot be separated and lost. When locked, the buckle has a very compact configuration. It includes a thin depending metal strip sandwiched between strap layers by means of which the stirrup leather can have a permanent twist imparted to it to cause the stirrup to hang properly.

7 Claims, 5 Drawing Figures

FIG.1
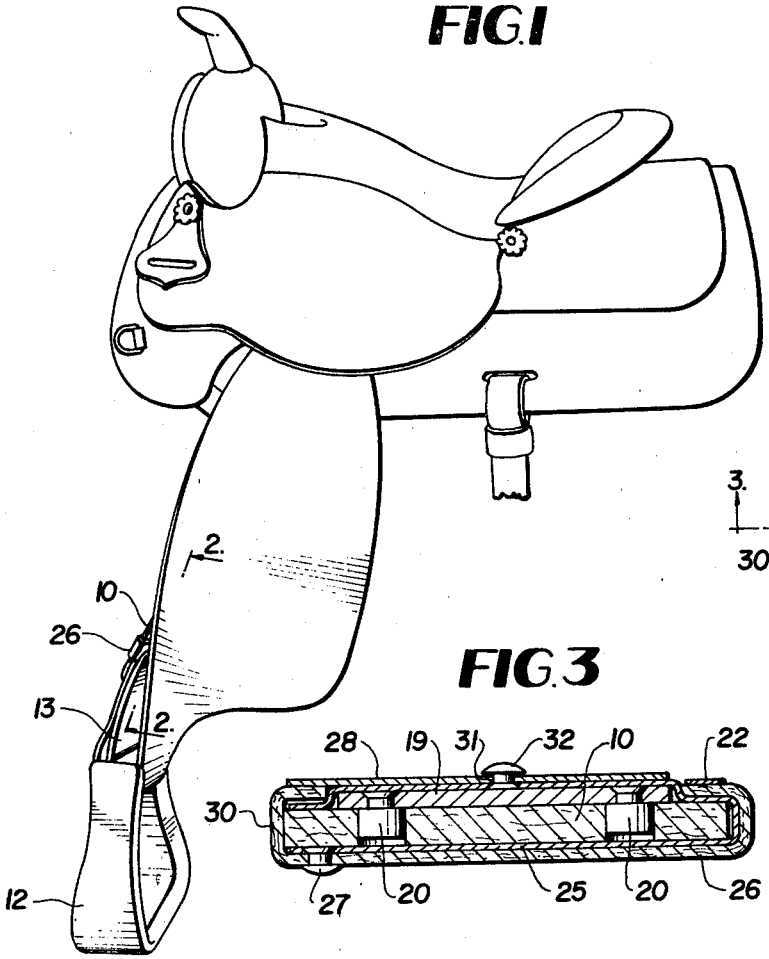
FIG.2
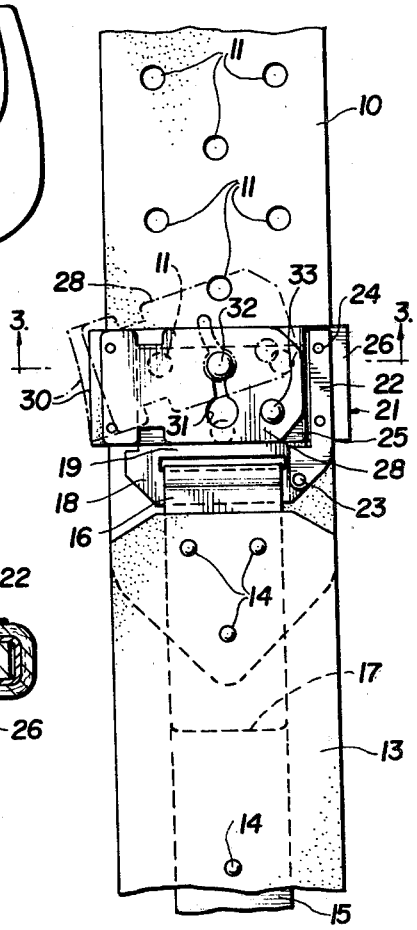
FIG.3
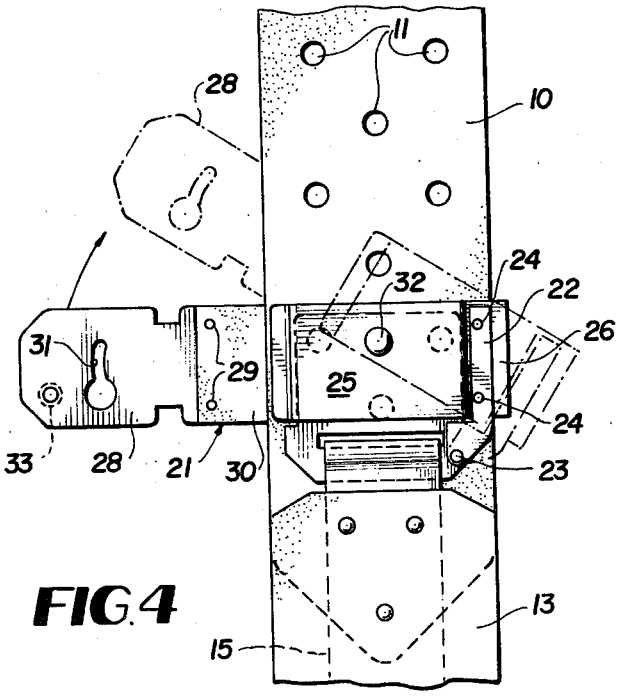
FIG.4
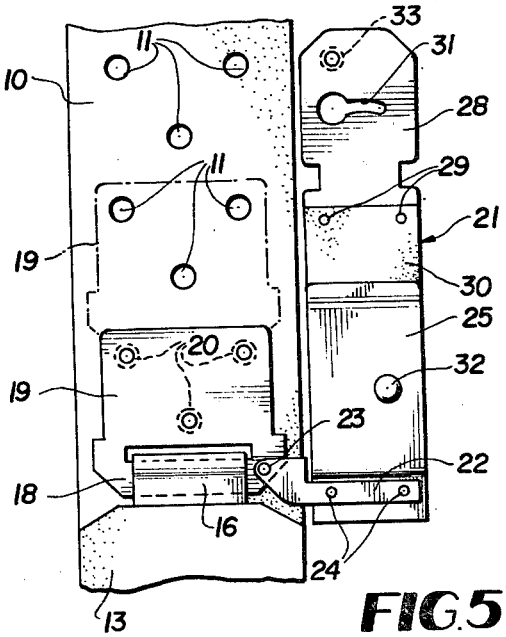
FIG.5

STIRRUP ADJUSTING AND LOCKING DEVICE

BACKGROUND OF THE INVENTION

The simple objective of the invention is to provide a stirrup strap adjuster and lock of improved construction, operational efficiency and security and which is practical and relatively economical to manufacture.

A further object of the invention is to provide, as a part of the adjuster and lock, an element which can impart a desired permanent twist to the stirrup strap causing the stirrup to hang properly at right angles to the horse's side.

Still another object is to provide a stirrup strap adjuster and lock which is very compact and does not excessively increase the thickness of the leather strap to which it is applied.

Another object is to provide a device of the mentioned character which is very easy to operate and very safe and secure in the locked condition.

Other objects and advantages of the invention will become apparent during the course of the following description.

BRIEF DESCRIPTION OF THE DRAWINGS

FIG. 1 is a side elevation of a saddle and stirrup having the adjuster and lock according to the invention.

FIG. 2 is an enlarged side elevation of the adjuster and lock taken on line 2—2 of FIG. 1.

FIG. 3 is an enlarged horizontal section taken on line 3—3 of FIG. 2.

FIG. 4 is a similar view showing a pivoted locking buckle, in broken lines in an intermediate released position.

FIG. 5 is a similar view showing the pivoted buckle fully released.

DETAILED DESCRIPTION

Referring to the drawings in detail wherein like numerals designate like parts, an upper stirrup strap section 10 has provided therein near its lower end a plurality of stirrup length adjusting openings 11 arranged in groups of three. A stirrup 12 is carried by a lower strap section 13 formed in two layers or plies. Anchored between the two layers of the lower strap section 13 as by rivets 14 is a thin metal strip 15 which can be permanently twisted in manufacturing to maintain a twist in each stirrup strap so that the stirrup 12 will normally hang at right angles to the side of the horse, FIG. 1, without pulling against the foot of the rider.

At its top, the twisted metal strip 15 emerges from the layered lower strap section 13 and is formed into a flat loop 16 having a plate extension 17 extending several inches down one outside face of the lower strap section 13 and anchored by the top three rivets 14.

Permanently attached within the flattened loop 16 is a bail 18 of a sturdy flat adjusting and locking plate 19 having projecting from the interior side thereof fixedly three cylindrical locking pins 20 spaced to properly engage in a chosen group of three of the openings 11 in upper strap section 10. When so engaged, the plate 19 lies flat upon one surface of the strap section 10, as shown in the drawings, and is positively locked thereto by the three pins 20. The length adjustment of each stirrup is achieved by entering the locking pins 20 of the plate 19 into different groups of the openings 11 along the length of upper strap section 10.

In order to lock the two stirrup straps 10 and 13 in selected length adjusted positions, an easily releasable but very secure locking buckle 21 is pivotally attached through a short metal arm 22 on the buckle to one corner of the locking plate 19 at one end of the bail 18 by a small pivot pin 23. The pivot arm 22 is riveted at 24 to a shallow U-formed metal buckle body 25 which can be swung with the arm 22 on the pivot pin 23 to engage over the upper strap section 10 and locking plate 19 when the locking pins 20 of such plate are fully engaged in a chosen three of the openings 11. The buckle body 25 thus straddles the strap section 10 and plate 19 snugly and spans them transversely at right angles to the axis of strap section 17 when the buckle is closed as shown in full lines in FIG. 2.

A leather strap 26 covers the exterior of one wall of the U-shaped buckle body 25 and may be anchored thereto near one end thereof by a single rivet 27, FIG. 3. The far end of the strap 26 is held by the two rivets 24 of pivoted arm 22 which carries the buckle 21.

The free end portion of the strap beyond the strap anchoring rivet 27 carries a flat rigid hasp plate 28 riveted to the strap at 29. The hasp plate can be flexed to an offset position from the buckle body 25 as shown in broken lines in FIG. 2 due to the flexibility of strap end portion 30. The hasp plate centrally contains a modified keyhole slot 31 having arcuate edges as shown. A coacting headed locking stud 32 on the adjacent side wall of buckle body 25 enters the keyhole slot 31 and securely locks the hasp plate in a closed position squarely on top of the buckle body 25 as shown in full lines in FIG. 2 and in FIG. 3. The arcuate formation of the keyhole slot 31 imparts an over-dead-center locking action of the hasp plate with the locking stud 32 for added security. To assist in sliding the hasp plate 28 to the release position relative to the stud 32, as shown in broken lines in FIG. 2, a thumb button 33 is preferably provided on the hasp plate near one of its forward corners.

The resulting construction of the stirrup adjuster and lock is highly compact, as shown in FIG. 3, and does not greatly increase the thickness of the stirrup strap. The invention provides a very efficient, convenient and secure means to adjust the length of the stirrup strap in increments and positively lock it in the selected adjusted position.

With the buckle fully released and swung to the side of the strap section 10 as shown in FIG. 5, the locking plate 19 with its three pins 20 can easily be shifted to another set of the adjusting and locking openings 11 to shorten or lengthen the stirrup strap composed of the two strap sections 10 and 13.

Following such length adjustment, the pivoted buckle 21 with its hasp plate extended is swung across the locking plate 19 to the position shown in full lines in FIG. 4 and the hasp plate is then swung to the closed position on top of the buckle body 25 and engaged with the locking stud 32 by flexure of the strap portion 30, as described. The device is easily released by a reverse operation.

It is to be understood that the form of the invention herewith shown and described is to be taken as a preferred example of the same, and that various changes in the shape, size and arrangement of parts may be resorted to, without departing from the spirit of the invention or scope of the subjoined claims.

We claim:

1. In a saddle stirrup, a stirrup suspension strap including two length adjustable strap sections, one strap section having a plurality of adjusting and locking openings formed therethrough, a flat adjusting and locking plate fastened to the other strap section and having spaced locking pins projecting from one side thereof for entry into selected openings of said one strap section, a U-formed locking buckle having an open end and a closed end pivotally attached to said locking plate and adapted to be swung across the latter and across said one strap section into straddling relationship therewith, a flexible strap having a free end carried by the U-formed locking buckle and adapted to be extended around the open end of said buckle and around an adjacent edge of the said one strap section, a rigid hasp plate secured to the free end of said flexible strap and having a locking slot therein, and an eccentrically located locking stud on one side wall of the buckle engageable lockingly within the locking slot of the hasp plate.

2. In a saddle stirrup as defined in claim 1, and one side wall of said buckle having said stud including an offset portion forming shallow shoulders embracing opposite edges of said adjusting and locking plate and forming exterior spaces for end portions of the flexible strap.

3. In a saddle stirrup as defined in claim 1, and said other strap section having attached thereto a thin elongated metal strip element which is permanently connected to the adjusting and locking plate and by means of which the stirrup suspension strap may be given a permanent twist to position the stirrup substantially at right angles to the adjacent side of a horse.

4. In a saddle stirrup as defined in claim 3, and said other strap section consisting of two layers of leather and said metal strip element being riveted permanently between said two layers.

5. In a saddle stirrup as defined in claim 1, and said locking slot comprising a modified keyhole slot having curved side edges in its narrow portion receiving the shank of said locking stud with an over-dead-center locking action when the hasp plate is in overlying parallel relationship to the locking buckle.

6. In a saddle stirrup as defined in claim 1, and a support arm carrying the locking buckle adjacent to the closed end thereof and being pivotally attached to said adjusting and locking plate.

7. In a saddle stirrup as defined in claim 3, and the metal strip element having a loop portion projecting from one end of said other strap section, and said adjusting and locking plate including a bail engaged within the loop portion.

* * * * *